US006196423B1

(12) United States Patent
Erxleben

(10) Patent No.: US 6,196,423 B1
(45) Date of Patent: Mar. 6, 2001

(54) CHILD RESISTANT OVERCAP WITH SAFETY COLLAR AND CONTAINING A CHILD RESISTANT SLIP COLLAR FOR SCREW-ON PUMP SPRAYERS

(75) Inventor: Frederick R. Erxleben, Brick Township, Ocean County, NJ (US)

(73) Assignee: Innopak, Inc.

( * ) Notice: Subject to any disclaimer, the term of this patent is extended or adjusted under 35 U.S.C. 154(b) by 0 days.

(21) Appl. No.: 09/557,807

(22) Filed: Apr. 25, 2000

(51) Int. Cl.[7] ..... B67B 5/00

(52) U.S. Cl. ..... 222/153.1; 222/153.09; 222/153.13; 222/182; 222/321.7

(58) Field of Search ..... 222/153.09, 153.1, 222/153.13, 182, 321.1, 321.7, 321.9; 239/333; 215/220

(56) References Cited

U.S. PATENT DOCUMENTS

| | | | |
|---|---|---|---|
| 3,927,834 | 12/1975 | Tada | 239/359 |
| 4,204,614 | 5/1980 | Reeve | 222/153 |
| 4,346,821 | 8/1982 | Wesner et al. | 222/153 |
| 4,366,921 | 1/1983 | Kirk, Jr. | 222/153 |
| 4,454,965 | 6/1984 | Kirk, Jr. | 222/153 |
| 4,781,311 | 11/1988 | Dunning et al. | 222/153 |
| 5,169,032 | 12/1992 | Steijns et al. | 222/153 |
| 5,238,152 | 8/1993 | Maas et al. | 222/153 |
| 5,356,043 | 10/1994 | Glynn | 222/153 |
| 5,462,181 | 10/1995 | Glynn | 215/204 |
| 5,477,989 | 12/1995 | Maas et al. | 222/153.1 |
| 5,509,580 | 4/1996 | Glynn | 222/153.1 |
| 5,520,305 * | 5/1996 | Pierson | 222/182 X |
| 5,551,582 | 9/1996 | Robinson | 215/216 |
| 5,657,905 * | 8/1997 | Glynn | 222/153.1 |
| 5,873,496 | 2/1999 | Montaner et al. | 222/153.9 |
| 5,938,081 | 8/1999 | Foster et al. | 222/153.09 |
| 5,938,082 | 8/1999 | Foster et al. | 222/153.9 |

* cited by examiner

*Primary Examiner*—Kenneth Bomberg
(74) *Attorney, Agent, or Firm*—Kenneth P. Glynn, Esq.

(57) ABSTRACT

The present invention relates to an improvement for a child resistant overcap with safety collar for screw-on pump sprayers. The device includes a main closure base for attachment to a container, an outer ring, a spray mechanism attached to the base and an overcap. The overcap is child resistant and can only be removed when corresponding protrusions and cut outs are in alignment. The sprayer mechanism has an inside threaded sprayer neck and the container has an outside threaded container neck upon which the threaded sprayer neck is attached. The device relates to the improvement of providing a child-resistant safety feature of including a non-flexible ring collar attached to the outside of the sprayer neck and adapted to rotate about the sprayer neck to inhibit undesired unthreading or threading of the sprayer neck from or to the container neck. The ring collar has an open top, an open bottom, antiremoval means to prevent removal of the ring collar from the sprayer neck, and at least one flexible engagement means.

20 Claims, 5 Drawing Sheets

CHILD RESISTANT OVERCAP WITH SAFETY COLLAR AND CONTAINING A CHILD RESISTANT SLIP COLLAR FOR SCREW-ON PUMP SPRAYERS

INCORPORATION BY REFERENCE

U.S. Pat. No. 5,356,043 to Kenneth P. Glynn; U.S. Pat. No. 5,462,181 to Kenneth P. Glynn; and U.S. Pat. No. 5,509,580 to Kenneth P. Glynn describe a screw-on, manually operated sprayer and container, the sprayer having an inside threaded sprayer neck and the container having an outside threaded container neck upon which the inside threaded sprayer neck is attached. The devices include various types of child resistant overcaps for sprayers and are incorporated herein by reference in their entirety.

BACKGROUND OF THE INVENTION

1. Field of the Invention

This invention relates to child-resistant overcaps in safety collars and, more particularly, to those containing a child-resistant slip collar for screw-on pump sprayers. The slip-collars require a complex motion of depressing a part of the collar while turning it.

2. Information Disclosure Statement

The following patents are representative of child resistant collars for screw-on pump sprayers:

U.S. Pat. No. 3,927,834 to Tetsuya Tada describes a sprayer which comprises a piston capable of being reciprocatingly moved in a cylindrical chamber, a lever for operating said piston, a valve for guiding a spray liquid from a container to said chamber, and a locking member for fixing said lever in a prescribed position and simultaneously allowing said piston to close said valve when the sprayer is out of use.

U.S. Pat. No. 4,204,614 to Randy F. Reeve describes a fluid dispenser which includes an actuator containing fluid passages defining a discharge path for fluid from a supply container to a discharge orifice, a needle valve lying adjacent the discharge path, a nipple surrounding the needle valve and a nozzle cap having an end wall containing a discharge orifice and being threadedly engaged with the nipple for movement of the end wall toward and away from the valve upon cap rotation. Discharge through the orifice may be positively shut-off upon rotation of the cap which causes the valve to be seated against the discharge orifice, and the nozzle cap may be locked in an off position upon engagement between a spring biased tab provided on the actuator and an inwardly extending shoulder provided on the skirt of the cap. A ramp member on the cap includes a ramp surface and the shoulder so as to effect inward deflection of the tab upon engagement with the ramp surface during cap rotation toward the off position. The tab then snaps into place against the shoulder upon continued cap rotation so as to prevent rotation of the cap which would cause the valve to unseat from the discharge orifice. The tab is manually deflectable for disengaging it from the shoulder to permit cap rotation allowing its end wall to move away from the valve.

U.S. Pat. No. 4,346,821 to Walter H. Wesner et al. describes a child resistant safety closure which is provided for closing the outlet of a hand-operated fluid product sprayer dispenser which is used on a container to prevent leaks from the container during periods of non-use and to resist accidental use by children or unwary adults. The closure cannot be moved from an "outlet closed" position to an "outlet open" position without the performance of at least two discrete, predetermined definite actions by the user to first disable a lock and then to linearly or rotatably move the cap into the "outlet open" position to permit spraying or dispensing. A closing member is connected to the bottom portion of the sprayer for removably mounting the sprayer to the container and closing the same. The member and the sprayer to which it is connected cannot be removed without the performance of at least two discrete, predetermined definite actions, which actions are difficult if not impossible for young children to perform.

U.S. Pat. No. 4,336,921 to Donald C. Kirk, Jr. describes a child resistant closure for a container having a threaded cylindrical neck. The container neck is provided with a plurality of outwardly extending ratchet-teeth on its exterior surface below the thread. The cap portion of the closure has a central opening in its top surface that receives the base of the article to be attached to the container neck, e.g. a trigger pump. A collar member is received on the lower end of the closure member and is axially movable thereon. The collar member is provided with a plurality of ratchet-teeth adapted to engage the ratchet-teeth on the neck of the container when the collar is in its lower or down position. The cap has spaced apart splines on its skirt which define recesses that receive inwardly directed lugs provided at the top of the collar. The engagement of the lugs and splines permit the collar to move axially on the cap but prevents separate radial movement between the collar and cap.

U.S. Pat. No. 4,454,965 to Donald C. Kirk, Jr. describes a child resistant trigger pump dispenser having an elongated, transversely oriented body member with the pump outlet at one end thereof and a vertically extending lower end section for receiving fluid from a container. The lower end section of the pump is equipped with a rigidly attached closure member having a multiplicity of short threads with projections adjacent their ends on the inner wall of the downwardly depending skirt. The container neck is provided on its outside surface with a multiplicity of long interrupted threads, some having recessed portions on their underside adjacent their terminal ends to receive the projections on the short threads on the closure member skirt portion. The closure member is provided with an upstanding boss which is received in an opening provided in the lower portion of the body member for accommodating the trigger arm whereby the transverse axis of the trigger pump can be oriented with respect to the engaging lugs provided on the closure means when the closure member is permanently fixed to the pump. The closure member is fixedly attached to the lower portion of the pump body during assembly so that when the pump is connected to an oval or non-cylindrical container having the long interrupted threads the projections on the short threads of the closure will engage the undercuts on the long threads so that the transverse axis of the pump is in alignment with the major transverse axis of the container to provide fixed orientation of the pump with respect to the container.

U.S. Pat. No. 4,781,311 to Walter B. Dunning et al. describes a cap and container especially suited for dispensing liquids which has a cap which is accurately aligned upon closure. The container is closed by applying downward axial pressure to the cap, thereby forcing lugs in the cap to pass over threads located on the neck of the container so that the cap is snapped on. Stop walls prevent any undesired cap rotation. Stabilizing lugs are alternatively provided to add additional stability. Alternatively, the container is closed by twisting or rotating the cap with respect to the neck. The cap may also be twisted or snapped off. Modifications in the neck configuration make the cap irremovable.

U.S. Pat. No. 5,169,032 to Emile B. Steijns et al. describes a trigger operated fluid dispensing device which is adapted to be mounted to a container. The device comprises a body having a top wall portion and front end portion. A nozzle assembly is provided at the front of the body and comprises a nose bushing at the front end of the body and a nozzle cap rotatably mounted to the nose bushing. The nozzle cap has blocking structure that is engageable with structure that prevents rotation of the nozzle cap. A pull-away piece is detachably connected to the top wall portion of the body and has extending structure extending into the area between the nozzle cop and the front end of the also provided a locking ring which is received over the cylindrical base mounted on the neck for maintaining the first and second coupling structures in a coupled locked position.

U.S. Pat. No. 5,356,043 to Kenneth P. Glynn discloses a spray dispenser device closure. It includes a main closure base for attachment to a container, an outer ring, a spray mechanism attached to the base and an overcap. The main closure base has a top portion with a circular horizontal track thereon for attachment with an outer ring. The outer ring has a circular inside wall with a horizontal track thereon for attachment to the track of the base so as to connect them in such a way as to be horizontally and freely rotatable thereabout. The outer ring body for engaging the blocking structure for preventing relative movement between the nozzle cap and the body.

U.S. Pat. No. 5,238,152 to Wilhelmus J. J. Maas et al. describes a child resistant trigger sprayer bottle cap/bottle neck assembly which comprises a trigger sprayer having a body which includes a cylindrical base. First coupling structure in the form of at least one deflectable tab with an opening therein is incorporated into the cylindrical base for coupling to a bottle neck. Second coupling structure in the form of a locking lug is provided on a bottle neck and is adapted to engage and couple with the first coupling structure by reason of the lug being received in the opening in the tab. There is has a top with an inwardly biased ledge for retaining an overcap and has at least one cut out on the ledge to permit an overcap to be inserted and removed from the outer ring. The spray mechanism is attached to the top of the base and extends therethrough for insertion into a container. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it cannot be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided.

U.S. Pat. No. 5,462,181 to Kenneth P. Glynn discloses a dispenser closure which includes a main closure base attached to a container, an outer ring, an inner cap removably attached to the base and an overcap. The main closure base has a top portion with a circular horizontal track thereon for attachment with an outer ring. The outer ring has a circular inside wall with a horizontal track thereon for attachment to the track of the base so as to connect them to the base in such a way as to be horizontally and freely rotatable thereabout. The outer ring has a top with an inwardly biased ledge for retaining an overcap to be inserted and removed from the outer ring. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it cannot be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided.

U.S. Pat. No. 5,477,989 to Wilhelmus J. J. Maas et al. describes a child resistant nozzle which is used to cover a nozzle cap of a nozzle assembly for a trigger sprayer having a body, the nozzle assembly including a nose bushing at a front end of the body, the nozzle cap being rotatably mounted on the nose bushing of the sprayer, and the nozzle cap having a proximal end, a distal end including a generally annular rear edge, and an outer surface. The cover comprises a generally annular hood substantially covering the outer surface of the nozzle cap, being rotatable about the nozzle cap and nose bushing and having a proximal end, a distal end, an outer peripheral surface and an inner generally annular surface. Retaining structure is provided at the proximal end of the hood for retaining the hood on the nozzle assembly. The hood is made of flexible or resilient material so that upon applying sufficient radial forces to the hood generally on a diameter extending transversely of the hood, the hood becomes distorted and frictionally engages the nozzle cap whereby the nozzle cap can be rotated by rotating the hood then engaging the nozzle cap.

U.S. Pat. No. 5,509,580 to Kenneth P. Glynn discloses a spray dispenser device closure. It includes a main closure base for attachment to a container, an outer ring, a spray mechanism attached to the base and an overcap. The main closure base has a top portion with a circular horizontal track thereon for attachment with an outer ring. The outer ring has a circular inside wall with a horizontal track thereon for attachment to the track of the base so as to connect them in such a way as to be horizontally and freely rotatable thereabout. The outer ring has a top with an outwardly biased ledge to permit an overcap to be inserted and removed from the outer ring. The spray mechanism is attached to the top of the base and extends therethrough for insertion into a container. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out.

U.S. Pat. No. 5,551,582 to Clayton L. Robinson describes a child resistant, snap on, twist off closure container package which is opened by squeezing and deflecting diametrically opposed side portions of the closure to bring cam followers into engagement which cams on the container so that subsequent turning causes axial displacement and opening movement of the closure from the container. Guide members prevent deforming of the closure to maintain sealing surfaces and adjoining surfaces of the closure and container in alignment with each other and prevent distortion on to expose surfaces which can be gripped by the fingers or teeth in an effort to open the closure and container in a manner other than the intended method of squeezing and twisting of the closure relative to the container.

U.S. Pat. No. 5,873,496 to Pedro Pares Montaner et al. describes a dispenser which has its closure cap non-removably affixed to a cylindrical attaching portion of its dispenser body by a snap-fit engagement between a folded lower end section of the attaching portion and the closure or a plug located within the closure and in engagement with the attaching portion. The folded lower end section presents an end edge facing outwardly of the closure which engages an inwardly facing end wall of the closure or of the plug.

U.S. Pat. No. 5,938,081 to Donald D. Foster et al. describes a closure which comprises a cap and container where the cap is integrally formed with a trigger sprayer housing and the cap and container have four thread connectors that attach the cap to the container by a quarter turn of the cap relative to the container, and where the cap also has locking tabs that snap over detentes on the container and hold the cap securely to the container preventing unintended separation of the cap from the container.

U.S. Pat. No. 5,938,082 to Donald D. Foster et al. describes a container assembly which comprises a container for containing fluid, and a container closure. The container includes a neck having a mouth therein for passage therethrough of liquid in the container, and a flange circumscribing and extending radially outwardly from the neck of the container. The flange includes a generally downwardly facing surface. The container closure comprises a closure cap portion adapted for releasable connection to the neck of the container. The closure cap portion comprises a generally annular-shaped skirt, and at least three protrusions extending generally radially inwardly from an inside surface of the skirt. The protrusions are circumferentially spaced from each other along the inside surface of the skirt. The protrusions of the closure cap portion and the flange of the container are configured for a resilient snap-fit engagement of the protrusions with the generally downwardly facing surface of the flange.

Notwithstanding the prior art, the present invention is neither taught nor rendered obvious thereby.

SUMMARY OF THE INVENTION

The present invention relates to a screw-on, manually operated sprayer and container. The sprayer has an inside threaded sprayer neck and the container has an outside threaded container neck upon which the inside threaded sprayer neck is attached. The present invention relates to the improvement of providing a child-resistant safety feature. This feature is a non-flexible ring collar removably attached to the outside of the sprayer neck and adapted to freely rotate about the sprayer neck to inhibit undesired unthreading or threading of the sprayer neck from or to the container neck. The ring collar has a continuous sidewall, an open top, an open bottom, antiremoval means located on the ring collar to prevent removal of the ring collar from the sprayer neck, and at least one flexible engagement means located on the sidewall. The flexible engagement means is moveable inwardly to frictionally engage the sprayer neck for frictional engagement therewith to permit removal of the sprayer neck from the container neck while the ring collar drops down and remains in place, and to permit attachment of the sprayer neck and ring collar simultaneously to the container neck. This is accomplished by depressing the at least one flexible engagement means against the sprayer neck and rotating the ring collar while so depressing the flexible engagement means.

U.S. Pat. Nos. 5,356,043; 5,462,181, and 5,509,580, all to Kenneth P. Glynn, describe a screw-on, manually operated sprayer and container, the sprayer having an inside threaded sprayer neck and the container having an outside threaded container neck upon which the inside threaded sprayer neck is attached, which includes various types of child resistant overcaps for sprayers and are incorporated herein by reference in their entirety. The present invention devices include this teaching along with the improvement feature described above. For example, the present invention may include a closure having:

(a) a main closure base for attachment to a container, the base having a top portion having a circular horizontal track thereon for attachment with an outer ring;

(b) an outer ring having a circular inside wall with a horizontal track thereon for attachment to the track of the base so as to connect the outer ring to the base so as to be horizontally and freely rotatable thereabout, the outer ring also having a top with an outwardly biased ledge for retaining an overcap, and having at least one cut-out on the ledge to permit an overcap to be inserted onto and removed from the outer ring;

(c) a spray mechanism attached to the top of the base and extending therethrough for insertion into a container;

(d) an overcap having a circular bottom adapted to be inserted into the outer ring and over the spray mechanism, the bottom having at least one protrusion thereon which has a geometry of adequate size to freely move through the at least one cut out of the ledge of the outer ring and when the overcap is so inserted and rotated, of adequate size and geometry to prevent removal of the overcap from said outer ring, except when the at least one protrusion and the at least one cut out are in alignment; and, further wherein the outer ring ledge has an underside and the at least one protrusion of the overcap has a top wherein the underside of the ledge and the top side of the at least one protrusion are in frictional contact with one another when the overcap is inserted into the outer ring such that when one of the outer ring and the overcap are rotated, the other of the outer ring and the overcap rotates therewith, and wherein the frictional contact may be overcome manually by holding one of the outer ring and the overcap and rotating the other of the outer ring and the overcap. The improvement involves providing a child-resistant safety feature, which comprises:

a non-flexible ring collar removably attached to the outside of the sprayer neck and adapted to freely rotate about the sprayer neck to inhibit undesired unthreading or threading of the sprayer neck from or to the container neck, the ring collar having a continuous sidewall, an open top, an open bottom, antiremoval means located on the ring collar to prevent removal of the ring collar from the sprayer neck, and at least one flexible engagement means located on the sidewall which is moveable inwardly to frictionally engage the sprayer neck for frictional engagement therewith to permit removal of the sprayer mechanism from the container neck while the ring collar drops down and remains in place, and to permit attachment of the sprayer neck and ring collar simultaneously to the container neck, by depressing the flexible engagement means against the sprayer neck and rotating the ring collar while so depressing the flexible engagement means.

In one embodiment of the invention, the antiremoval means of the ring collar is an inwardly projecting protrusion located on the bottom rim of the ring collar and adapted to fit under the sprayer neck. In some preferred embodiments, the flexible engagement means is at least one hinged engagement means which is a partially cut out portion of the sidewall. In more preferred embodiments, the flexible engagement means is two hinged engagement means, e.g. the two hinged engagement means are located opposite one another. These may be integrally formed with the ring collar as a single piece. In some embodiments, the hinged engagement means may include a friction enhancing outer surface. In other embodiments, the hinged engagement means includes a friction enhancing inner surface.

Some embodiments of the present invention include a screw-on, manually operated sprayer and container wherein the antiremoval means is adapted to snap onto the sprayer neck and is sufficiently flexible to fit over the sprayer neck and lock onto the sprayer neck to inhibit removal and permit rotation.

In another similar, but revised embodiment, there is a screw-on, manually operated sprayer and container, the sprayer having an inside threaded sprayer neck and the container having an outside threaded container neck upon which the inside threaded sprayer neck is attached, which includes a closure having:

(a) a main closure base for attachment to a container, the base having a top portion having a circular horizontal track thereon for attachment with an outer ring;

(b) an outer ring having a circular inside wall with a horizontal track thereon for attachment to the track of the base so as to connect the outer ring to the base so as to be horizontally and freely rotatable thereabout, the outer ring also having a top with an inwardly biased ledge for retaining an overcap, and having at least one cut out on the ledge to permit an overcap to be inserted and removed from said outer ring;

(c) a spray mechanism attached to the top of the base and extending therethrough for insertion into a container;

(d) an overcap having a circular bottom adapted to be inserted into the outer ring and over the spray mechanism, the bottom having at least one protrusion thereon which has a geometry of adequate size to freely move through the at least one cut out of the ledge of the outer ring and when the overcap is so inserted and rotated, of adequate size and geometry to prevent removal of the overcap from the outer ring, except when the at least one cut out and the at least one protrusion are in alignment; and, further wherein the outer ring ledge has an underside and the at least one protrusion of the overcap has a top wherein the underside of the ledge and the top side of the at least one protrusion are in frictional contact with one another when the overcap is inserted into the outer ring such that when one of the outer ring and the overcap are rotated, the other of the outer ring and the overcap rotates therewith, and wherein the frictional contact may be overcome manually by holding one of the outer ring and the overcap and rotating the other of the outer ring and the overcap. The improvement involves a child-resistant safety feature, which includes:

a non-flexible ring collar removably attached to the outside of the sprayer neck and adapted to freely rotate about the sprayer neck to inhibit undesired unthreading or threading of the sprayer neck from or to said container neck, the ring collar having a continuous sidewall, an open top, an open bottom, antiremoval means located on the ring collar to prevent removal of the ring collar from the sprayer neck, and at least one flexible engagement means located on the sidewall which is moveable inwardly to frictionally engage the sprayer neck for frictional engagement therewith to permit removal of the sprayer mechanism from the container neck while the ring collar remains attached to the sprayer neck, and to permit attachment of the sprayer neck and ring collar simultaneously to the container neck, by depressing the at least one flexible engagement means against the sprayer neck and rotating the ring collar while so depressing the at least one flexible engagement means.

In another embodiment of the present invention, the ring collar and the outer ring are integrally formed as one piece. The single piece combined ring collar and outer ring is connected to the main base closure. Antiremoval means on the ring collar portion prevents removal of the sprayer unless the engagement means are depressed and the single piece combined ring collar and outer ring is rotated simultaneously.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention relates to an improvement for a spray dispenser device closure. The spray dispenser device closure includes a main closure base for attachment to a container, an outer ring, a spray mechanism attached to the base and an overcap. The sprayer mechanism has an inside threaded sprayer neck and the container has an outside threaded container neck upon which the threaded sprayer neck is attached. The present invention relates to the improvement of providing a child-resistant safety feature of including a non-flexible ring collar attached to the outside of the sprayer neck and adapted to freely rotate about the sprayer neck to inhibit undesired unthreading or threading of the sprayer neck from or to the container neck. The ring collar has a continuous sidewall, an open top, an open bottom, antiremoval means located on the ring collar to prevent removal of the ring collar from the sprayer neck, and at least one flexible engagement means located on the sidewall.

In one embodiment, the antiremoval means of the ring collar is an inwardly projecting protrusion located on the bottom of the ring collar and adapted to fit under the sprayer neck. In some embodiments, the flexible engagement means is a flap with three sides of the flexible engagement means cut out. In some preferred embodiments, the flexible engagement means is at least one hinged engagement means which is a partially cut out portion of the sidewall. In more preferred embodiments, the flexible engagement means is two hinged engagement means, e.g. the two hinged engagement means are located opposite one another. These may be integrally formed with the ring collar as a single piece. In some embodiments, the hinged engagement means may include a friction enhancing outer surface. In other embodiments, the hinged engagement means includes a friction enhancing inner surface. In other embodiments, the ring collar and an outer ring which is attached to the container via amain base closure are integrally formed as one piece.

Figure 3:
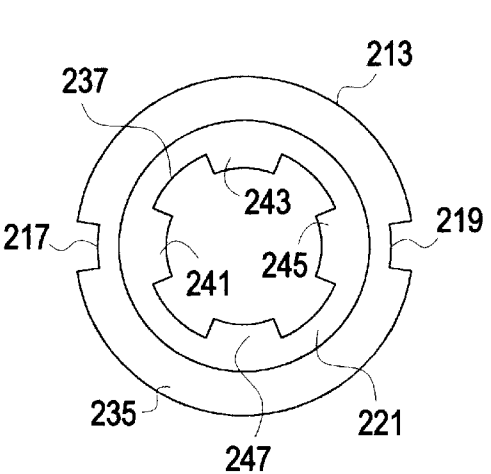
FIG. 3 shows a bottom view of a present invention outer ring and ring collar.
Figure 2:
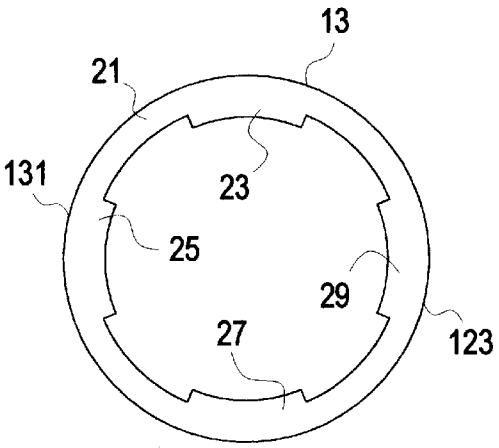
FIG. 2 shows a top view of a prior art invention collar ring.
Figure 1:
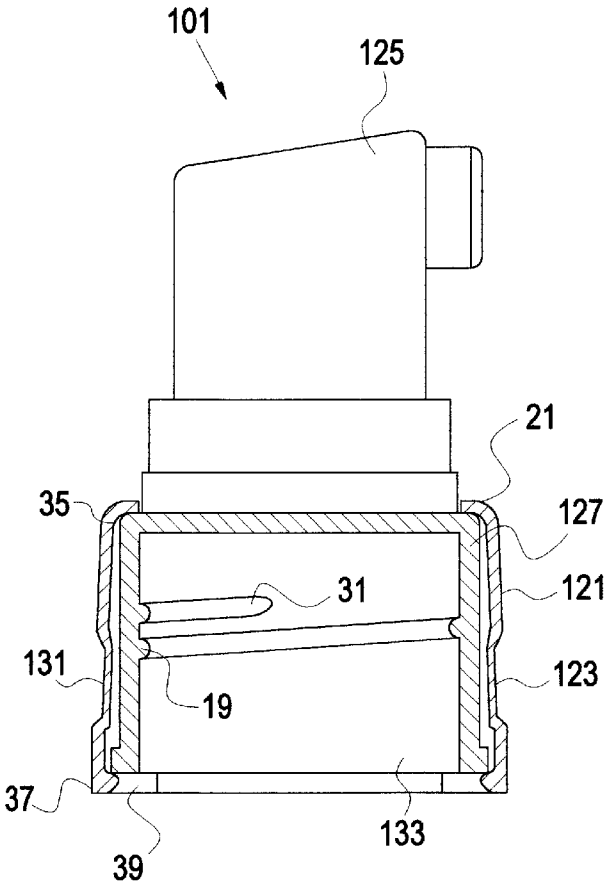
FIG. 1 shows a side, partial cut, partial view.

Referring now to FIGS. 1 and 2, there is shown a ring collar 121 or collar of a device 101. The device is the subject matter of copending application, filed on Mar. 23, 2000, entitled Child Resistant Slip Collar for Screw-on Pump Sprayer by the same inventor herein, and is herein incorporated by reference in its entirety. The device 101 includes the ring collar 121, a sprayer 125, and a container 133. The sprayer 125 include a sprayer neck 127 and threads 19 which mate with container threads 31 on container 133. Attached to the outside of the sprayer neck 127 is the non-flexible ring collar 121 which is adapted to freely rotate about the sprayer neck 127 to inhibit undesired unthreading or threading of the sprayer neck 127 to or from the container neck 133.

The ring collar 121 or collar has a continuous sidewall 35, an open top 21, an open bottom 37, anti-removal means 39, at least one flexible engagement means 123, 131 and positioning means 23, 25, 27 and 29. The at least one flexible engagement means 123, 131, is moveable inwardly to frictionally engage the sprayer neck 127 and includes serrations so that fingers do not slip when the engagement means 123, 131 is depressed. In this embodiment, the at least one flexible engagement means 123, 131 are thinned portions of the sidewall 35 which are integrally formed with the ring collar 121 as a single piece. Antiremoval means 39 is adapted to snap onto the sprayer neck 127 and is sufficiently flexible to fit over the sprayer neck 127 to inhibit removal and permit rotation.

In operation, the depressing of at least one flexible engagement means 123, 131 while rotating the ring collar 121 will permit removal of the sprayer neck 127 and ring collar 121 simultaneously from the container neck 133. To attach the ring collar 121 and the sprayer neck 127 simultaneously to the container neck 133, the at least one flexible engagement means 123, 131 is depressed while rotating the ring collar 121 at the same time.

Referring now to FIGS. 3 through 6, there is shown a present invention child resistant overcap with safety collar and containing a child resistant slip collar for screw-on pump sprayers 201. U.S. Pat. Nos. 5,356,043; 5,462,181, and 5,509,580, all to Kenneth P. Glynn, describe a screw-on, manually operated sprayer and container, the sprayer having an inside threaded sprayer neck and the container having an outside threaded container neck upon which the inside threaded sprayer neck is attached, which includes various types of child resistant overcaps for sprayers and are incorporated herein by reference in their entireties.

The device 201 includes a container 203 having a threaded neck, an overcap 205, a pump sprayer 225, a ring collar 221 and an outer ring 213. In this embodiment, the ring collar 221 and the outer ring 213 are separate pieces. The overcap 205 includes protrusions 251, 253 which are sized and shaped to fit onto a corresponding cut-out 217, 219 on outer ring 213. The pump sprayer 225 has a sprayer neck 227, a pump pusher mechanism 226 and a dispensing orifice 229. Attached to a main closure base, which, as described in the prior art, attaches to the container 203, is the outer ring 213. Outer ring 213 includes the at least one cut-out 217, 219 on outwardly biased ledge 215 to permit the overcap 205 to be inserted and removed from the outer ring 213.

The ring collar 221 includes a continuous sidewall 235, an open top 239, an open bottom 237, at least one flexible engagement means 223, 231 and anti-removal means 241, 243, 245 and 247. The at least one flexible engagement means 223, 231 is moveable inwardly to frictionally engage the sprayer neck 227 and includes serrations so that fingers do not slip when the engagement means 223, 231 is depressed. In addition, the inner surface of the at least one flexible engagement means 223, 231 is serrated to frictionally enhance the engagement means 223, 231 with the sprayer neck 227. In this embodiment, the at least one flexible engagement means 223, 231 are thinned portions of the sidewall 235 which are integrally formed with the ring collar 221 as a single piece. The at least one flexible engagement means 223, 231 are hingedly moveable inwardly to frictionally engage the sprayer neck 227. Anti-removal means 241, 243, 245 and 249 are flexible protrusions extending from the bottom 237 of the ring collar 221 and are adapted to snap onto the sprayer neck 227 and have sufficient flexibility to fit over the sprayer neck 227 to inhibit removal and permit rotation.

In operation, when overcap 205 is locked in place over the container 203, the overcap 205 cannot be removed until an alignment indicator 211 on the overcap 205 is lined up with alignment indicator 209 on the container 203. When this occurs, protrusions 251, 253 on the underside of the overcap 205 align with cut outs 217, 219 on the outer ring 213, which allows the protrusions 251, 253 to move through the cuts out 217, 219. This causes the overcap 205 to be removed from the device 201. Once the overcap 205 is removed, it cannot be replaced until protrusions 251, 253 are aligned with cut outs 217, 219 and the overcap 205 or the outer ring 213 is rotated.

Figure 6:
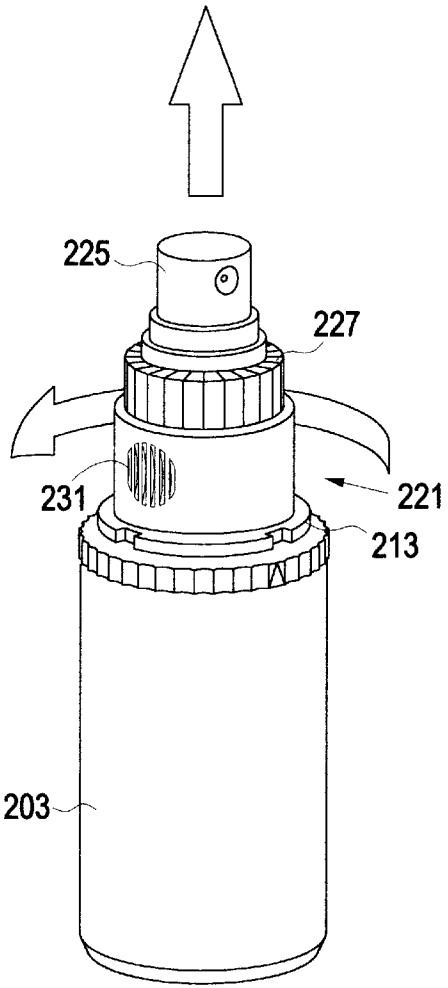
FIGS. 4, 5 and 6 show front oblique views of a child-resistant overcap with safety collar in use with the outer ring and ring collar shown in FIG. 3.
Figure 5:
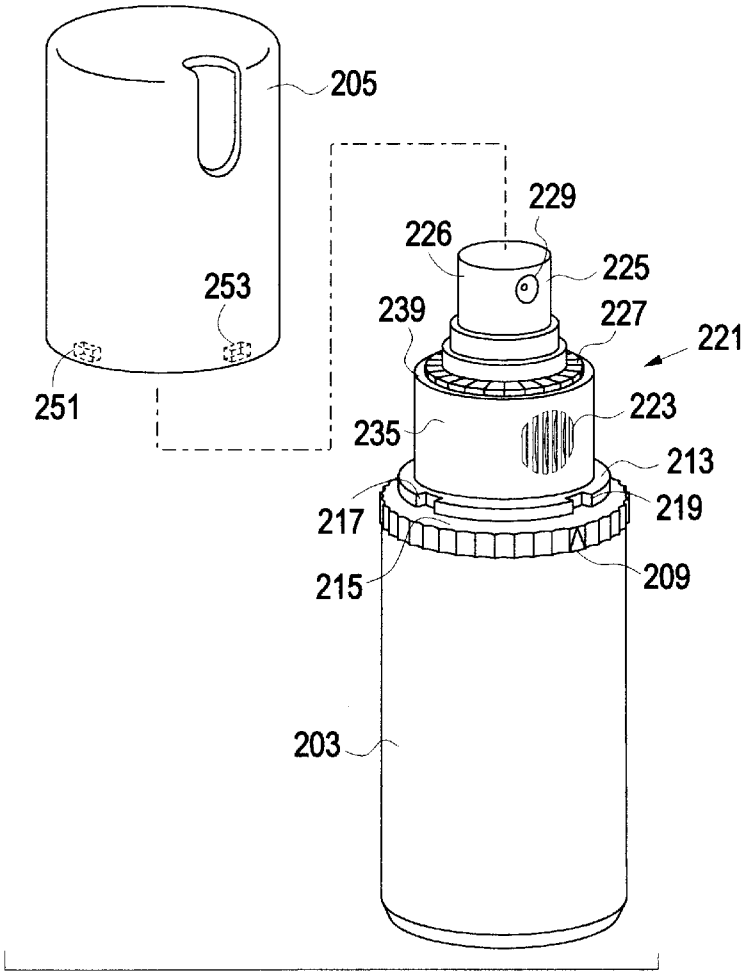
Figure 4:
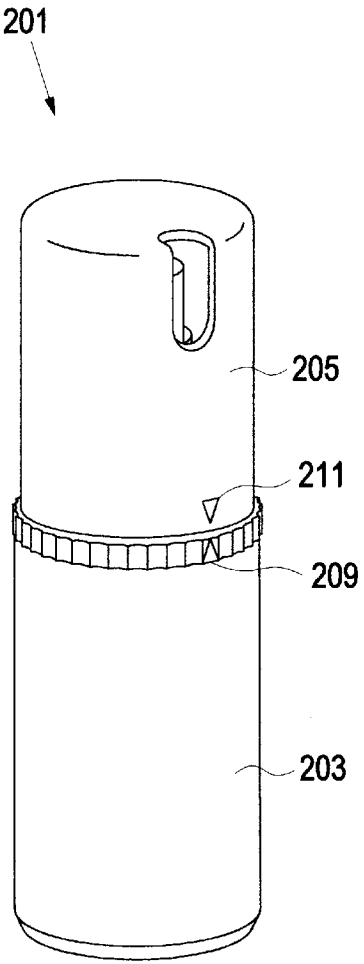

Once the overcap 205 is removed, to remove the sprayer 225 from the container 203, the depressing of at least one flexible engagement means 223, 231 while rotating the ring collar 221 will permit removal of the sprayer neck 227 from the container neck. As shown in FIG. 6, the sprayer neck 227 is unthreaded from the container threads and moves upwardly through the antiremoval means 241, 245, 247 and 249 while the ring collar 221 drops down and remains in place. To attach the ring collar 221 and the sprayer neck 227 simultaneously to the container neck, the at least one flexible engagement means 223, 231 is depressed, while rotating the ring collar 221 at the same time, thereby allowing the sprayer neck 227 to be threaded onto the container neck.

Figure 9:
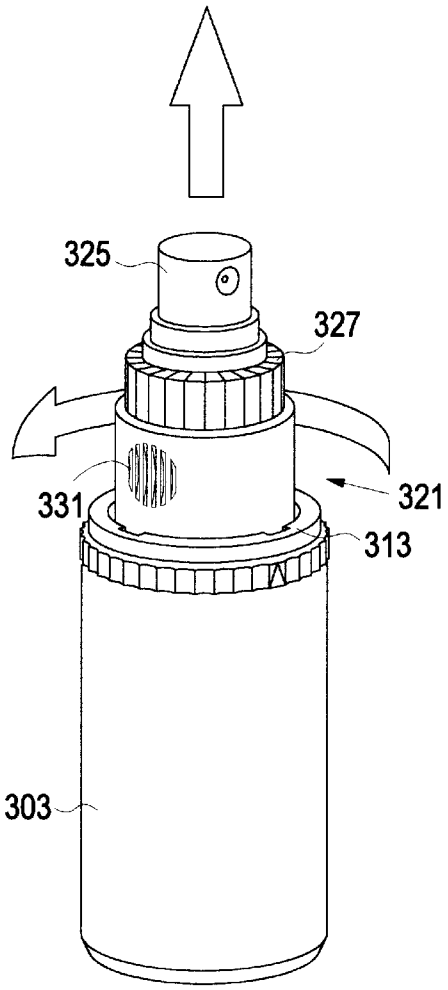
FIGS. 7, 8, and 9 show front oblique views of an alternative embodiment of a child-resistant overcap with safety collar and containing a child-resistant ring collar.
Figure 8:
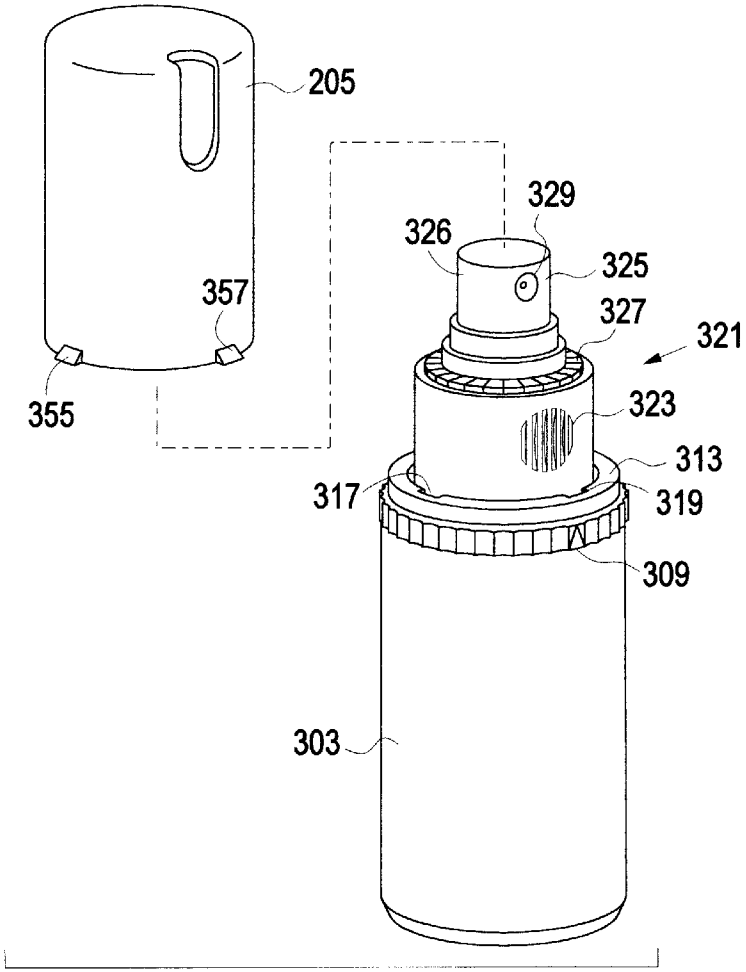
Figure 7:
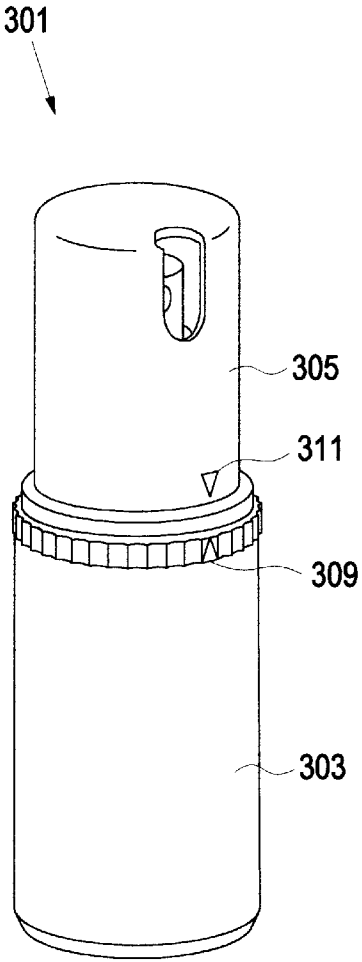
Figure 12:
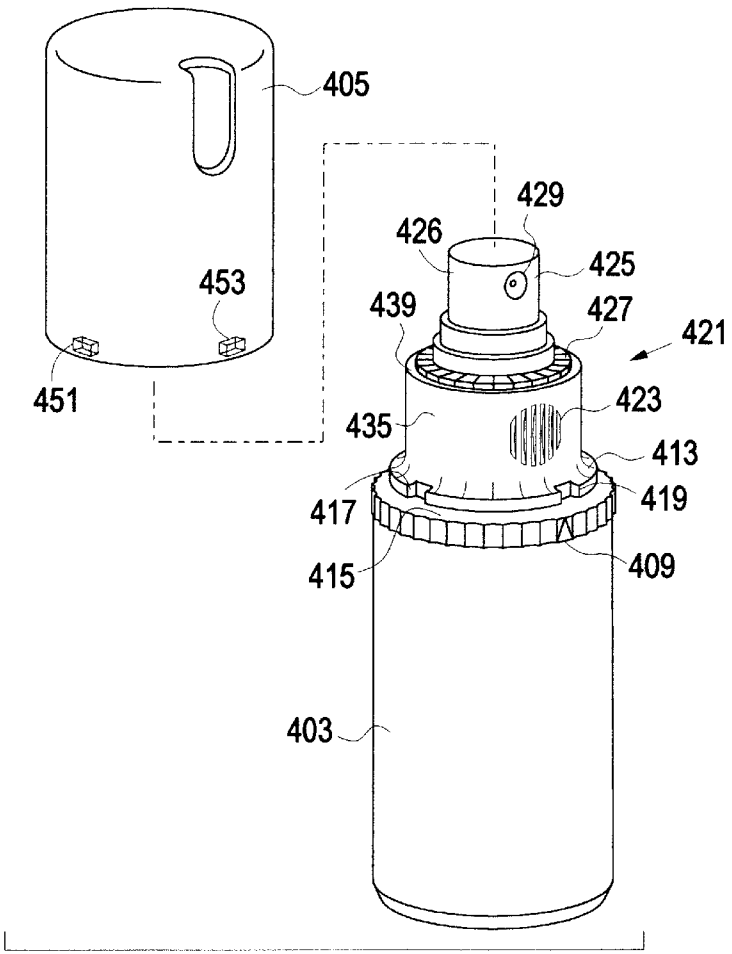
FIGS. 11, 12, and 13 show front oblique views of still yet another alternative embodiment of a child-resistant overcap with safety collar in use with the single piece combined outer ring and ring collar shown in FIG. 10.
Figure 11:
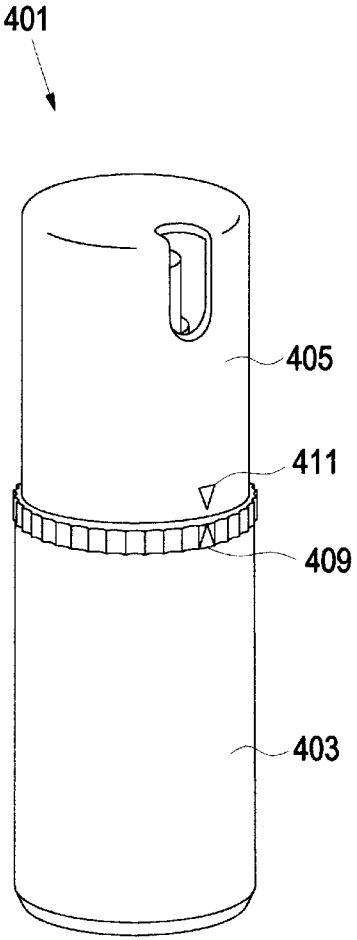
Figure 10:
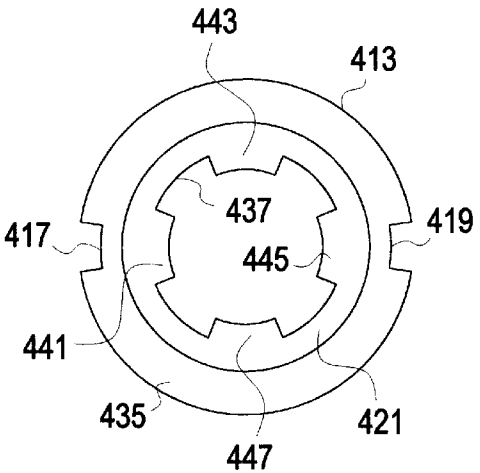
FIG. 10 shows a bottom view of a present invention single piece combined outer ring and ring collar.

Referring now to FIGS. 7, 8 and 9, there is shown front oblique views of an alternative embodiment of a child-resistant overcap with safety collar 301 in use with the present invention ring collar 321. This embodiment is identical to the embodiment shown in FIGS. 3, 4, 5 and 6 with the exception of outer ring 313 and overcap 305. Identical parts are similarly numbered as in FIGS. 3–5, but beginning with "3".

The overcap includes at least one protrusion 355, 357 on the outside of the overcap 305. Outer ring 313 includes at least one cut-out 317, 319 on inwardly biased ledge 315 of the outer ring 313 to permit the overcap 305 to be inserted and removed from the outer ring 313 by aligning the at least one protrusion 355, 357 on the overcap 305 with the at least one cut-out 317, 319. The operation of the attachment and removal of the collar ring 321 and the sprayer neck 327 is the same as described in FIGS. 3–6.

Referring now to FIGS. 10, 11, 12, and 13 there is shown bottom and front oblique views of an alternative embodiment of a child-resistant overcap with safety collar in use with the present invention slip ring collar device 401. This embodiment is identical to the embodiment shown in FIGS. 3–6, with the exception of the outer ring 413 and ring collar 421. In this embodiment, the outer ring 413 and ring collar 421 are integrally molded to form one piece. Identical parts are similarly numbered as in FIGS. 3–6, but beginning with "4".

The device 401 incudes a container 403 having a threaded neck, an overcap 405, a pump sprayer 425 and a single piece combined ring collar 421 and outer ring 413. The overcap 405 includes protrusions 451, 453 which are sized and shaped to fit onto corresponding cut-outS 417, 419 on single piece combined ring collar 421 and outer ring 413. The pump sprayer 425 has a sprayer neck 427, a pump pusher mechanism 426. and a dispensing orifice 429. Attached to a main closure base, which, as described in the prior art, attaches to the container 403, is the single piece combined ring collar 421 and outer ring 413. The outer ring portion 413 includes the at least one cut-outS 417, 419 on outwardly biased ledge 415 to permit the overcap 405 to be inserted and removed from the single piece combined ring collar 421 and outer ring 413.

The ring collar portion 421 includes a continuous sidewall 435, an open top 439, an open bottom 437, at least one flexible engagement means 423, 431 and anti-removal means 441, 443, 445 and 447. The at least one flexible engagement means 423, 431 is moveable inwardly to frictionally engage the sprayer neck 427 and includes serrations so that fingers do not slip when the engagement means 423, 431 is depressed. In addition, the inner surface of the at least one flexible engagement means 423, 431 is serrated to frictionally enhance the engagement means 423, 431 with the sprayer neck 427. In this embodiment, the at least one flexible engagement means 423, 431 are thinned portions of the sidewall 435 which are integrally formed with the ring collar portion 421 as a single piece. The at least one flexible engagement means 423, 431 are hingedly moveable inwardly to frictionally engage the sprayer neck 427. Anti-removal means 441, 443, 445 and 449 are flexible protrusions extending from the bottom 437 of the ring collar 421 and are adapted to snap onto the sprayer neck 427 and have sufficient flexibility to fit over the sprayer neck 427 to inhibit removal and permit rotation.

In operation, when overcap 405 is locked in place over the container 403, the overcap 405 cannot be removed until an alignment indicator 411 on the overcap 405 is lined up with alignment indicator 409 on the container 403. When this occurs, protrusions 451, 453 on the underside of the overcap 405 align with cut outs 417, 419 on the outer ring portion 413, which allows the protrusions 451, 453 to move through the cut outs 417, 419. This causes the overcap 405 to be removed from the device 401. Once the overcap 405 is removed, it cannot be replaced until protrusions 451, 453 are aligned with cut outs 417, 419 and the overcap 405 or the single piece outer ring 413 and ring collar 421 is rotated.

Figure 13:
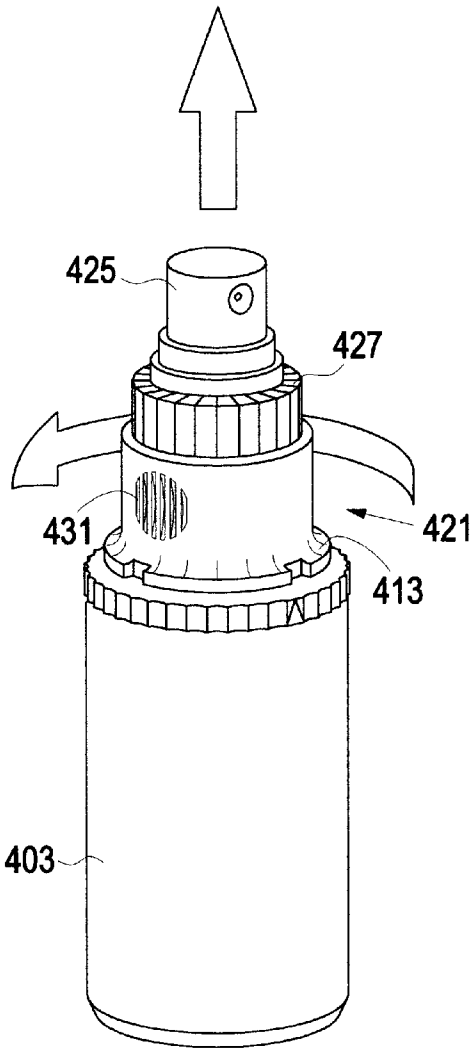

Once the overcap 405 is removed, to remove the sprayer 425 from the container 403, the depressing of at least one flexible engagement means 423, 431 while rotating the single piece combined outer ring 413 and ring collar 221 will permit removal of the sprayer neck 227 from the container neck. As shown in FIG. 13, the sprayer neck 427 is unthreaded from the container threads and moves upwardly through the anti-removal means 441, 445, 447 and 449 while the single piece combined outer ring 413 and ring collar 421 remains in place due to the connection of the outer ring portion 413 to the main closure base. To attach the single piece combined outer ring 413 and ring collar 421, and the sprayer neck 427 simultaneously to the container neck, the at least one flexible engagement means 423, 431 is depressed, while rotating the single piece combined outer ring 413 and ring collar 421 at the same time, thereby allowing the sprayer neck 227 to thread onto the container neck and the outer ring portion 413 to connect with the main closure base.

Figure 14:
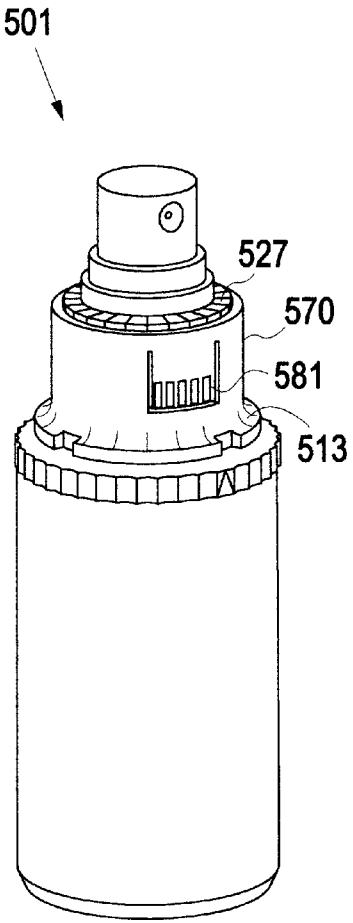
FIG. 14 shows an alternative embodiment single piece outer ring and ring collar for the present invention device shown in FIGS. 10–13.

Referring now to FIG. 14, there is shown an alternative embodiment of a single piece outer ring 513 and ring collar 570 used in a present invention device 501. The single piece outer ring 513 and ring collar 570 is circular and is adapted to freely rotate about a sprayer neck 527 to inhibit undesired unthreading or threading of the sprayer neck from or to the container neck. The device 501 is identical to the embodiment shown in FIGS. 10–13, but includes an alternate embodiment ring collar portion 570. Identical parts are similarly numbered but beginning with '5'.

The ring collar portion 570 includes at least one flexible engagement means 581, which is moveable inwardly to frictionally engage the sprayer neck 525. The at least one flexible engagement means 581 is hinged and serrated to frictionally enhance the grasp with a hand. In addition, the inner surface of the at least one flexible engagement means 581 is serrated to frictionally enhance the engagement means 581 with the sprayer neck. Moreover, the at least one flexible means 581, is a flap with a bottom portion and sides separated from the ring collar portion 570.

Obviously, numerous modifications and variations of the present invention are possible in light of the above teachings. For example, instead of having cut outs on the outer ring and protrusions on the overcap, these elements could be reversed with protrusions on the outer ring and cut outs on the overcap. It is therefore understood that within the scope of the appended claims, the invention may be practiced otherwise than as specifically described herein.

What is claimed is:

1. In a screw-on, manually operated sprayer and container, the sprayer having an inside threaded sprayer neck and the container having an outside threaded container neck upon which the inside threaded sprayer neck is attached, which includes a closure having:

(a) a main closure base for attachment to a container, said base having a top portion having a circular horizontal track thereon for attachment with an outer ring;

(b) an outer ring having a circular inside wall with a horizontal track thereon for attachment to the track of said base so as to connect said outer ring to said base so as to be horizontally and freely rotatable thereabout, said outer ring also having a top with an outwardly biased ledge for retaining an overcap, and having at least one cut-out on said ledge to permit an overcap to be inserted onto and removed from said outer ring;

(c) a spray mechanism attached to the top of said base and extending therethrough for insertion into a container;

(d) an overcap having a circular bottom adapted to be inserted into said outer ring and over said spray mechanism, said bottom having at least one protrusion thereon which has a geometry of adequate size to freely move through said at least one cut out of said ledge of said outer ring and when said overcap is so inserted and rotated, of adequate size and geometry to prevent removal of said overcap from said outer ring, except when said at least one protrusion and said at least one cut out are in alignment; and, further wherein said outer ring ledge has an underside and said at least one protrusion of said overcap has a top wherein the underside of said ledge and the top side of said at least one protrusion are in frictional contact with one another when said overcap is inserted into said outer ring such that when one of said outer ring and said overcap are rotated, the other of said outer ring and said overcap rotates therewith, and wherein said frictional contact may be overcome manually by holding one of said outer ring and said overcap and rotating the other of said outer ring and said overcap, the improvement of providing a child-resistant safety feature, which comprises:

a non-flexible ring collar removably attached to the outside of said sprayer neck and adapted to freely rotate about said sprayer neck to inhibit undesired unthreading or threading of said sprayer neck from or to said container neck, said ring collar having a continuous sidewall, an open top, an open bottom, antiremoval means located on said ring collar to prevent removal of said ring collar from said sprayer neck, and at least one flexible engagement means located on said sidewall which is moveable inwardly to frictionally engage said sprayer neck for frictional engagement therewith to permit removal of said sprayer neck from said container neck while said ring collar drops down and remains in place, and to permit attachment of said sprayer neck and ring collar simultaneously to said container neck, by depressing said at least one flexible engagement means against said sprayer neck and rotating said ring collar while so depressing said at least one flexible engagement means.

2. The screw-on, manually operated sprayer and container of claim 1 wherein said at least one flexible engagement means is at least one hinged engagement means which is a partially cut out portion of said sidewall.

3. The screw-on, manually operated sprayer and container of claim 1 wherein said at least one flexible engagement means is two hinged engagement means.

4. The screw-on, manually operated sprayer and container of claim 3 wherein said two hinged engagement means are located opposite one another.

5. The screw-on, manually operated sprayer and container of claim 1 wherein said antiremoval means of said ring collar is at least one inwardly projecting protrusion located on said bottom of said ring collar and adapted to fit under said sprayer neck.

6. The screw-on, manually operated sprayer and container of claim 1 wherein said manually operated sprayer is a vertical pump sprayer.

7. The screw-on, manually operated sprayer and container of claim 2 wherein said at least one hinged engagement means is integrally formed with said ring collar as a single piece.

8. The screw-on, manually operated sprayer and container of claim 2 wherein said at least one hinged engagement means includes a friction enhancing outer surface.

9. The screw-on, manually operated sprayer and container of claim 2 wherein said at least one hinged engagement means includes a friction enhancing inner surface.

10. In a screw-on, manually operated sprayer and container, the sprayer having an inside threaded sprayer neck and the container having an outside threaded container neck upon which the inside threaded sprayer neck is attached, which includes a closure having:

(a) a main closure base for attachment to a container, said base having a top portion having a circular horizontal track thereon for attachment with an outer ring;

(b) an outer ring having a circular inside wall with a horizontal track thereon for attachment to the track of said base so as to connect said outer ring to said base so as to be horizontally and freely rotatable thereabout, said outer ring also having a top with an inwardly biased ledge for retaining an overcap, and having at least one cut out on said ledge to permit an overcap to be inserted and removed from said outer ring;

(c) a spray mechanism attached to the top of said base and extending therethrough for insertion into a container;

(d) an overcap having a circular bottom adapted to be inserted into said outer ring and over said spray mechanism, said bottom having at least one protrusion thereon which has a geometry of adequate size to freely move through said at least one cut out of said ledge of said outer ring and when said overcap is so inserted and rotated, of adequate size and geometry to prevent removal of said overcap from said outer ring, except when said at least one protrusion and said at least one cut out are in alignment; and, further wherein said outer ring ledge has an underside and said at least one protrusion of said overcap has a top wherein the underside of said ledge and the top side of said at least one protrusion are in frictional contact with one another when said overcap is inserted into said outer ring such that when one of said outer ring and said overcap are rotated, the other of said outer ring and said overcap rotates therewith, and wherein said frictional contact may be overcome manually by holding one of said outer ring and said overcap and rotating the other of said outer ring and said overcap, the improvement of providing a child-resistant safety feature, which comprises:

a non-flexible ring collar removably attached to the outside of said sprayer neck and adapted to freely rotate about said sprayer neck to inhibit undesired unthreading or threading of said sprayer neck from or to said container neck, said ring collar having a continuous sidewall, an open top, an open bottom, antiremoval means located on said ring collar to prevent removal of said ring collar from said sprayer neck, and at least one flexible engagement means located on said sidewall which is moveable inwardly to frictionally engage said sprayer neck for frictional engagement therewith to permit removal of said sprayer neck from said container neck while said ring collar drops down and remains in place, and to permit attachment of said sprayer neck and ring collar simultaneously to said container neck, by depressing said at least one flexible engagement means against said sprayer neck and rotating said ring collar while so depressing said at least one flexible engagement means.

11. The screw-on, manually operated sprayer and container of claim 10 wherein said at least one flexible engagement means is at least one hinged engagement means which is a partially cut out portion of said sidewall.

12. The screw-on, manually operated sprayer and container of claim 10 wherein said at least one flexible engagement means is two hinged engagement means.

13. The screw-on, manually operated sprayer and container of claim 12 wherein said two hinged engagement means are located opposite one another.

14. The screw-on, manually operated sprayer and container of claim 11 wherein said at least one hinged engagement means includes a friction enhancing outer surface.

15. In a screw-on, manually operated sprayer and container, the sprayer having an inside threaded sprayer neck and the container having an outside threaded container neck upon which the inside threaded sprayer neck is attached, which includes a closure having:

(a) a main closure base for attachment to a container, said base having a top portion having a circular horizontal track thereon for attachment with an outer member;

(b) an outer member including an outer ring portion having a circular inside wall with a horizontal track thereon for attachment to the track of said base so as to connect said outer member to said base so as to be horizontally and freely rotatable thereabout, said outer ring portion also having a top with an outwardly biased ledge for retaining an overcap, and having at least one cut-out on said ledge to permit an overcap to be inserted onto and removed from said outer member;

(c) a spray mechanism attached to the top of said base and extending therethrough for insertion into a container;

(d) an overcap having a circular bottom adapted to be inserted into said outer member and over said spray mechanism, said bottom having at least one protrusion thereon which has a geometry of adequate size to freely move through said at least one cut out of said ledge of said outer member and when said overcap is so inserted and rotated, of adequate size and geometry to prevent removal of said overcap from said outer member, except when said at least one protrusion and said at least one cut out are in alignment; and, further wherein said outer member ledge has an underside and said at least one protrusion of said overcap has a top wherein the underside of said ledge and the top side of said at least one protrusion are in frictional contact with one another when said overcap is inserted into said outer member such that when one of said outer member and said overcap are rotated, the other of said outer member and said overcap rotates therewith, and wherein said frictional contact may be overcome manually by holding one of said outer member and said overcap and rotating the other of said outer member and said overcap, the improvement of providing a child-resistant safety feature, which comprises:

said outer member further including a non-flexible ring collar portion located on a top portion of said outer member wherein said outer member is adapted to freely rotate about said sprayer neck to inhibit undesired unthreading or threading of said sprayer neck from or to said container neck, and wherein said ring collar portion has a continuous sidewall, an open top, antiremoval means to prevent removal of said outer member from said sprayer neck, and at least one flexible engagement means located on said sidewall which is moveable inwardly to frictionally engage said sprayer neck for frictional engagement therewith to permit removal of said sprayer neck from said container neck while said outer member remains attached to said main closure and to permit attachment of said sprayer neck and outer member simultaneously to said container neck, by depressing said at least one flexible engagement means against said sprayer neck and rotating said outer member while so depressing said at least one flexible engagement means.

16. The screw-on, manually operated sprayer and container of claim 15 wherein said at least one flexible engagement means is at least one hinged engagement means which is a partially cut out portion of said sidewall.

17. The screw-on, manually operated sprayer and container of claim 15 wherein said at least one flexible engagement means is two hinged engagement means.

18. The screw-on, manually operated sprayer and container of claim 17 wherein said two hinged engagement means are located opposite one another.

19. The screw-on, manually operated sprayer and container of claim 17 wherein said two hinged engagement means are located opposite one another.

20. The screw-on, manually operated sprayer and container of claim 16 wherein said at least one hinged engagement means includes a friction enhancing outer surface.

* * * * *